US005462186A

United States Patent [19]

Ladina et al.

[11] Patent Number: 5,462,186

[45] Date of Patent: Oct. 31, 1995

[54] CAM FOLLOWER CLOSURE ON CONTAINER WITH CAM TRACK FINISH

[75] Inventors: Joseph M. Ladina, Marietta; Timothy R. Exley; William A. Szedon, both of Stone Mountain, all of Ga.

[73] Assignee: The Coca Cola Company, Atlanta, Ga.

[21] Appl. No.: 284,143

[22] Filed: Aug. 2, 1994

[51] Int. Cl.[6] ..... B65D 41/04; B65D 55/02

[52] U.S. Cl. ..... 215/330; 215/218; 215/223; 220/240; 220/296; 220/316

[58] Field of Search ..... 215/217, 218, 215/223, 252, 329, 330, 270, 271; 220/214, 288, 296, 298, 293, 240, 316

[56] References Cited

U.S. PATENT DOCUMENTS

| | | | |
|---|---|---|---|
| 234,342 | 11/1880 | Stewart . | |
| 1,254,616 | 1/1918 | Matindale . | |
| 1,907,254 | 5/1933 | Dodge . | |
| 2,001,980 | 5/1935 | Sexton . | |
| 2,590,270 | 3/1952 | Pratt . | |
| 2,695,111 | 11/1954 | Voss . | |
| 3,127,049 | 3/1964 | Welty et al. . | |
| 3,211,320 | 10/1965 | Peters . | |
| 3,386,611 | 6/1968 | Crute . | |
| 3,749,270 | 7/1973 | Affleck . | |
| 3,987,921 | 10/1976 | Aichinger . | |
| 4,084,717 | 4/1978 | King | 215/217 |
| 4,289,248 | 9/1981 | Lynn . | |
| 4,442,945 | 4/1984 | Sandhaus | 215/330 X |
| 4,456,137 | 6/1984 | Lyman . | |
| 4,553,678 | 11/1985 | Thorsbakken | 215/218 |
| 4,697,715 | 10/1987 | Beruvides | 215/330 |
| 4,712,699 | 12/1987 | Lutz . | |
| 4,763,804 | 8/1988 | O'Connell . | |
| 5,135,124 | 8/1992 | Wobser | 220/293 X |
| 5,169,033 | 12/1992 | Shay | 215/330 X |
| 5,238,130 | 8/1993 | Marques et al. | 215/216 |
| 5,282,540 | 2/1994 | Beck . | |
| 5,307,946 | 5/1994 | Molinaro | 215/330 X |

*Primary Examiner*—Allan N. Shoap
*Assistant Examiner*—Nathan J. Newhouse

[57] ABSTRACT

A mating closure and finish system particularly adapted for use with containers, e.g. bottles containing carbonated beverages which generate gas in the bottle headspace and where the bottle finish incorporates at least two equally spaced helical cam tracks. The closure is comprised of plural sets of cam followers which fit into the cam tracks and where the cooperation between the cam tracks and cam followers produces an axial movement of the closure as it is rotated on the finish. For a two track system, which is the preferred embodiment, each track starts 180° from each other and makes at least one full turn around the circumference of the finish. Also included are intervening stops and tapered speed bumps that contact and impede the cam follower(s) in the cam tracks during closure removal to effect a delay. Raised thread segments which define the cam tracks are intersected by a plurality of vertical venting slots or pathways along their helical length to vent headspace gas. Longitudinally extending grooves are located in raised thread segments on either side of the cam tracks and couple with the vertical venting slots to provide a continuous venting conduit of the headspace gas. Anti-backoff devices are furthermore provided which operate when the closure is seated on the finish to keep the closure from backing off the finish and leaking prior to closure removal.

22 Claims, 7 Drawing Sheets

CAM FOLLOWER CLOSURE ON CONTAINER WITH CAM TRACK FINISH

BACKGROUND OF THE INVENTION

This invention relates generally to finish and closure arrangements for containers such as bottles and more particularly to a bottle finish and closure system for containers of carbonated beverages.

Conventional mating closure and bottle finish structures for carbonated beverage containers typically utilize a screw type or threaded arrangement between the closure and the finish of the container body and take many forms and configurations.

SUMMARY OF THE INVENTION

It is the primary object of the present invention to provide an improved closure and finish system for containers of carbonated beverages.

It is another object of the invention to provide a closure and finish system which vents headspace gas.

It is another object of the invention to provide a closure and finish system which incorporates features that effect a delay during closure removal.

It is a further object of the invention to provide a closure and finish system which prevents the closure from backing off the finish when the closure is seated thereon.

It is yet another object of the invention to provide a closure which is easier to apply to the finish on the bottling line.

It is yet a further object of the invention to provide a closure and finish arrangement wherein mutual contact is provided across a minimum of 180° of the finish at all times thus facilitating closure application and removal.

Briefly, the foregoing and other objects of the invention are achieved by a mating closure and finish system particularly adapted for use with containers, e.g. bottles containing beverages which generate gas in the bottle headspace and where the bottle finish incorporates two or more equally spaced helical cam tracks. The closure is comprised of plural sets of cam followers which fit into the cam tracks and the cooperation between the cam tracks and cam followers produces an axial movement of the closure as it is rotated on the finish.

For a two track system, which is the preferred embodiment, each track starts 180° from each other and makes at least one full turn around the circumference of the finish. Some or all of the cam tracks contain intervening stops that catch the leading or lowermost follower in each corresponding track during closure removal to effect a delay. It is the headspace gas pressure that causes the followers to jog axially and engage the stops. Some or all of the cam tracks additionally contain tapered speed bumps which are adapted to contact and impede the cam followers, more so during closure removal than closure application, to effect an additional delay during closure removal. Also, the thread sections include a plurality of vertical venting slots or pathways along their helical length to allow the venting of headspace gas. Longitudinally extending grooves are located in raised thread segments on either side of the cam tracks and couple with the vertical venting slots to provide a continuous venting conduit. Anti-backoff devices are also provided which operate when the closure is seated on the finish to keep the closure from backing off the finish and leaking prior to closure removal.

BRIEF DESCRIPTION OF THE DRAWINGS

The following detailed description will be more readily understood when considered together with the accompanying drawings wherein.

DETAILED DESCRIPTION OF THE INVENTION

Figure 1:
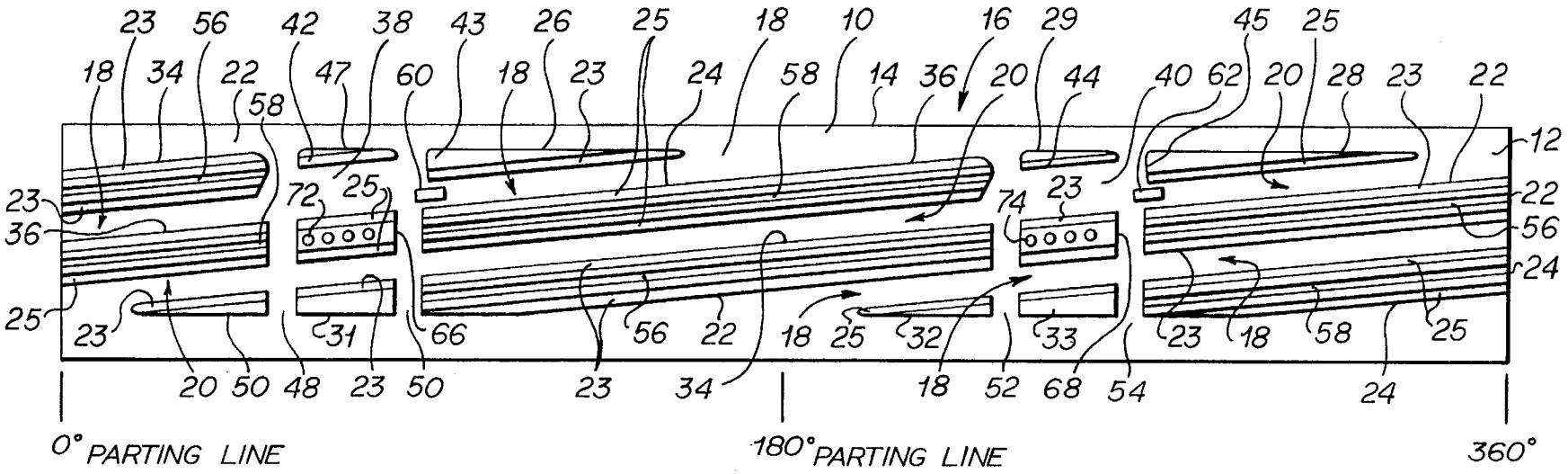
FIG. 1 is a linear projection of the finish in accordance with the subject invention located on the outside neck surface of a bottle-type container.
Figure 2:
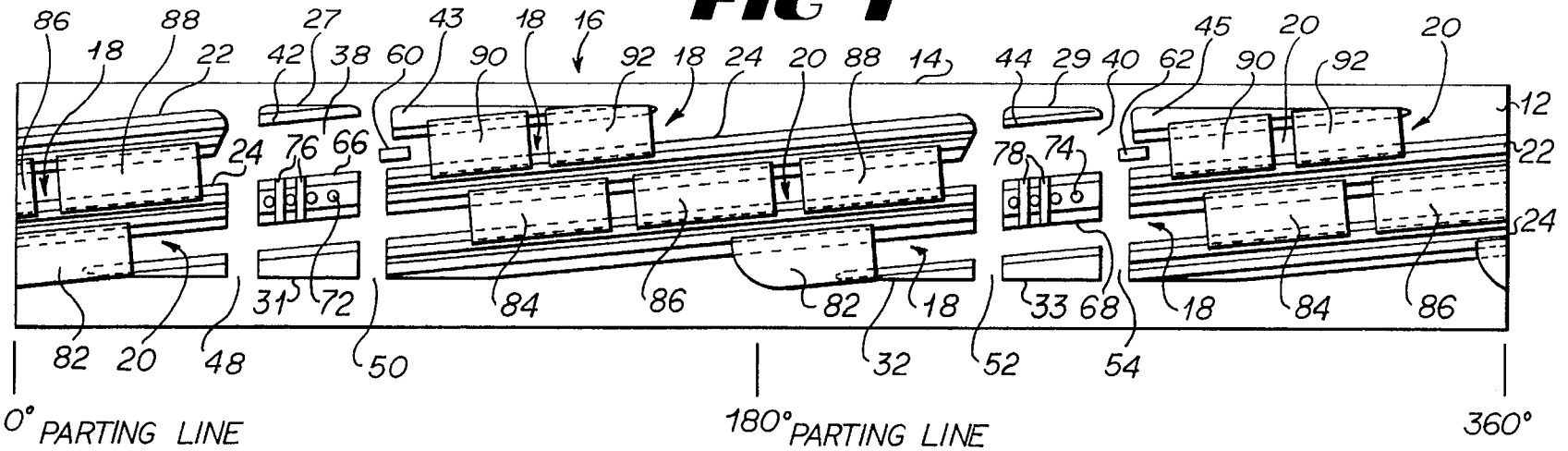
FIG. 2 is a linear projection of the finish shown in FIG. 1 but now additionally including the elements making up the inside surface of a bottle closure, with the closure being in a sealed closed position.
Figure 3:
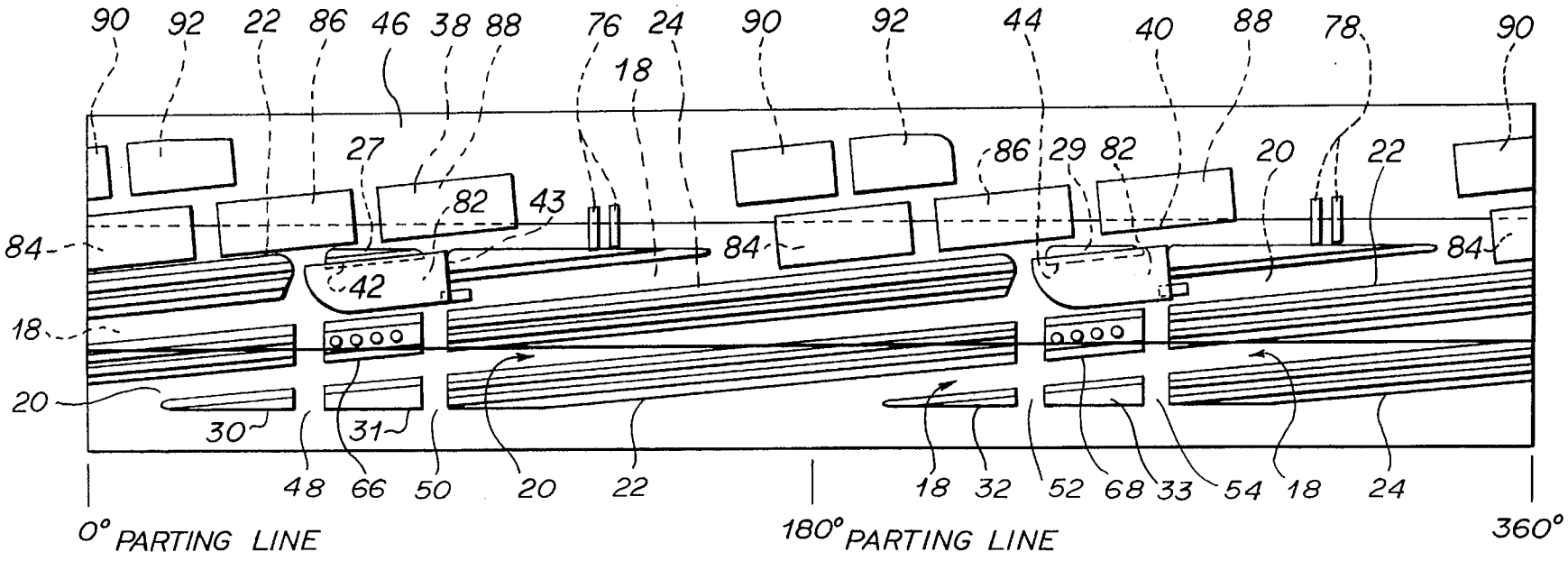
FIG. 3 is a linear projection of the closure shown in FIG. 2 but with the closure being in a partially disengaged or raised position with the lowermost closure follower in each track engaged in the intervening stop in each track.

Referring now collectively to the drawings and more particularly to the linear projections of the invention shown in FIGS. 1, 2, and 3, reference numeral 10 denotes the outside circumferential wall surface of the neck portion 12 (FIG. 4) of a container, not shown, for carbonated beverages. The container preferably comprises a well known bottle-type container fabricated from plastic material such as polyethyleneteraphalate (PET). The neck portion 12 includes an uninterrupted annular flat top rim 14 which acts as a sealing surface at the mouth 16 of the container when a closure is applied.

Located below the mouth 16 are two cam tracks 18 and 20 which spiral around the surface 10 for a complete revolution but which begin and end substantially 180° apart from one another. Although two cam tracks are shown in the preferred embodiment, additional cam tracks can be utilized when desired. If more than two cam tracks are provided, the starting points thereof would be equally spaced. Each of the cam tracks 18 and 20 are located between raised surfaces comprising segments of two adjacent non-continuous spiral threads 22 and 24 having inclined sidewall surfaces 23 and 25, respectively, as shown in FIG. 2A. Each of the raised threads 22 and 24 include: tapered first or start segments 26 and 28, followed by partial segments 27 and 29; last and next-to-last run-out segments 30, 31 and 32, 33; and a plurality of intermediate segments 34 and 36, including anti-backoff segments 66 and 68, respectively.

Figure 4:
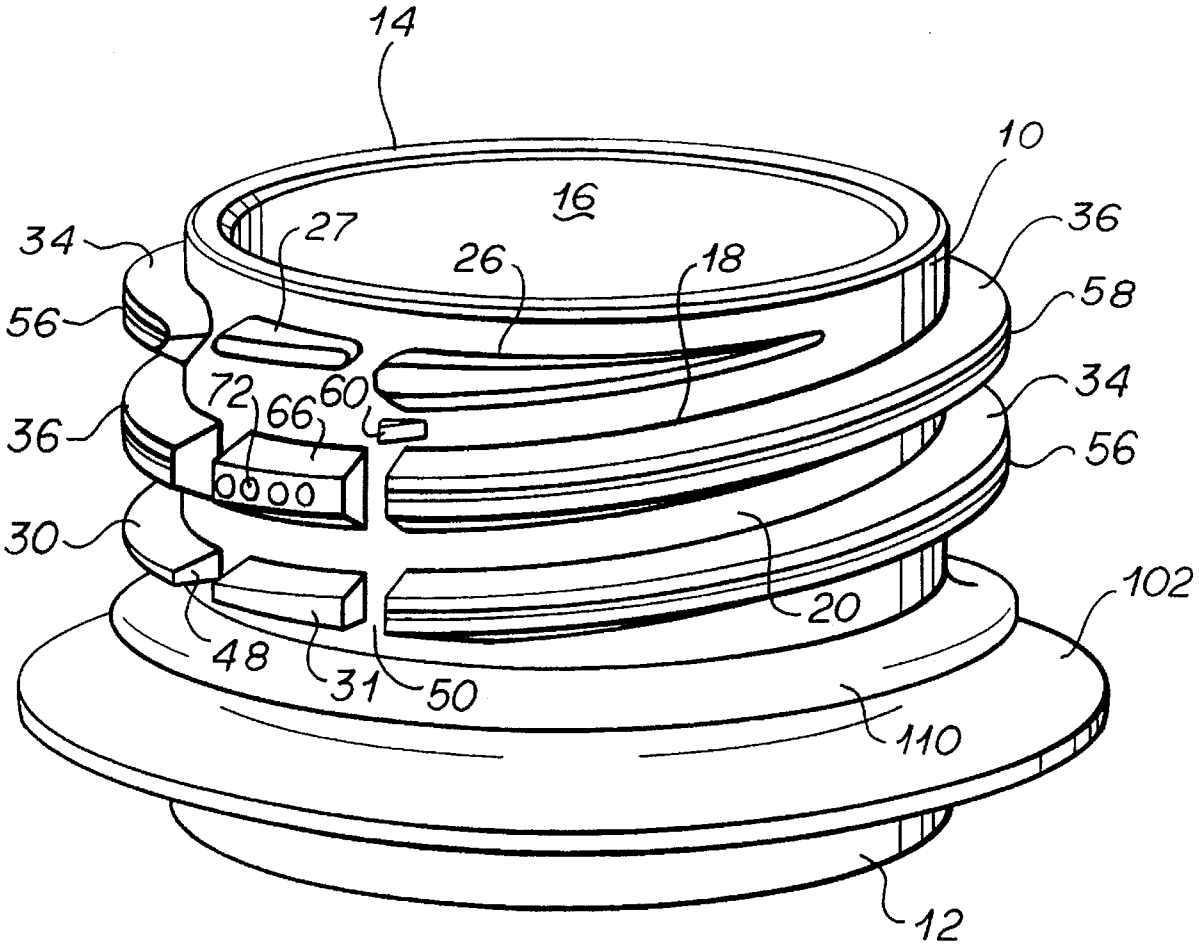
FIG. 4 is a perspective view illustrative of a cam track embodiment of a finish in accordance with the subject invention.

Further, following each first segment 26 and 28, of the respective threads 22 and 24, intervening stops 38 and 40 are provided which are defined by the inner edges 42 and 44 of the second segments 27 and 29, the inner edges 43 and 45 of the first segments 26 and 28, and the space below segments 27 and 29. The purpose of the intervening stops is to stop and hold the lowermost cam follower segment 82, i.e., the first one on and the last one off, of a cam follower arrangement on a closure 46 (FIG. 5) and as shown in FIG. 4, to effect a delay during closure removal. It is the headspace gas pressure that causes cam follower segment 82 to jog axially and engage interviewing stops 38 and 40. The number and location of the intervening stops, however, can be varied, when desired, depending on the specific structural requirements of the closure/finish design.

Further as shown in FIG. 1, vertical venting slots 48, 50, 52 and 54 are formed on both sides of the upper and lower thread segments 27, 31 and 29, 33 at the location of the intervening stops 38 and 40 and cross the cam tracks 18 and 20. The venting slots 48, 50, 52 and 54 are coupled together by means of elongated venting grooves 56 and 58 respectively located in the top surface of the raised threads 22 and 24 (FIG. 2A) so as to provide a continuous venting conduit for the gas in the headspace of the container when the closure 46 is unseated from the sealing surface 14 as shown, for example, in FIG. 6.

Figure 2B:
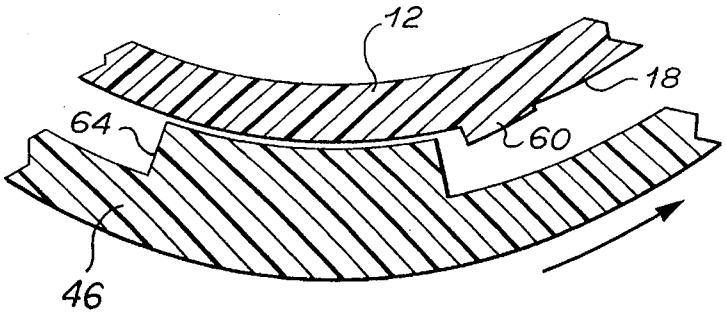
FIGS. 2B and 2C are partial cross-sectional views illustrative of a speed bump and its engagement with a closure follower segment.
Figure 2C:
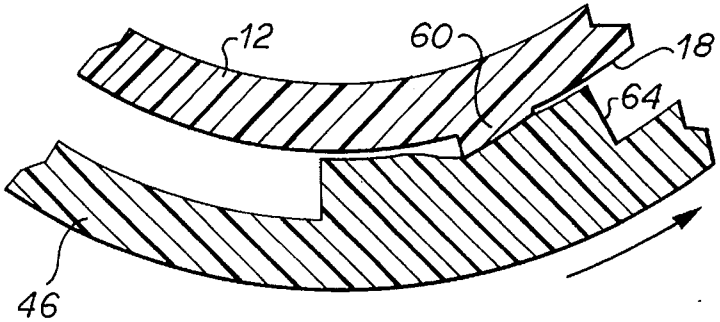
Figure 2A:
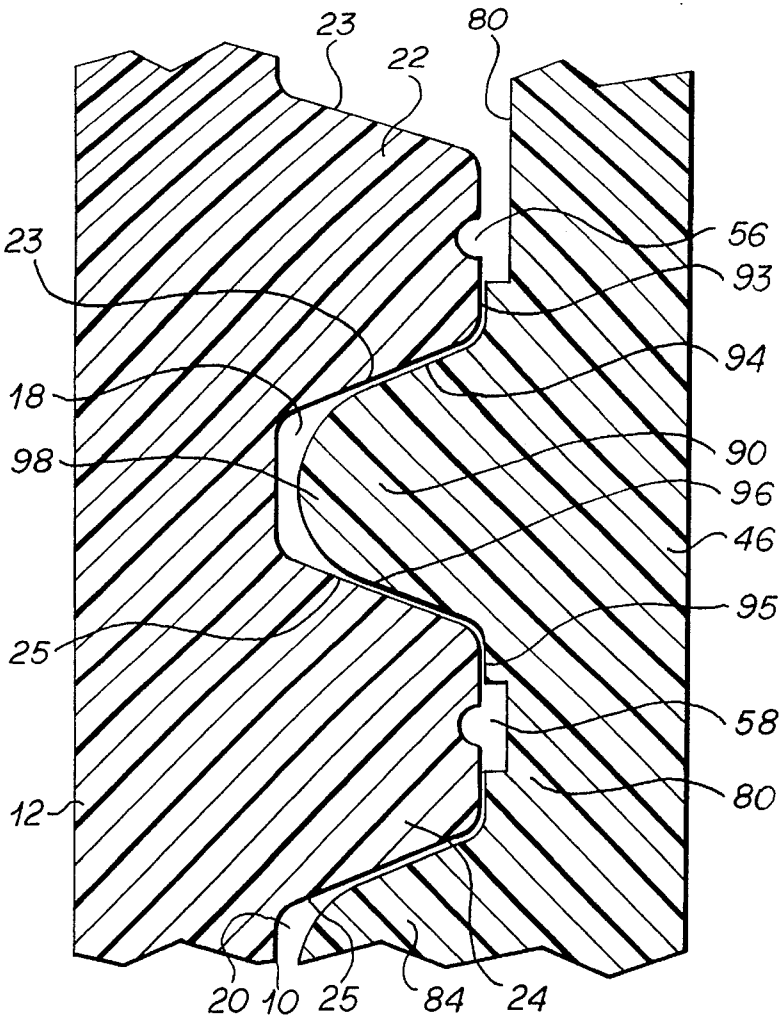
FIG. 2A is a partial transverse cross-sectional view further illustrative of the cam tracks and closure segments shown in FIG. 2.

FIG. 1 also shows a pair of ramp type speed bumps 60 and 62, one of which, i.e. speed bump 60, is shown in cross-section in FIGS. 2B and 2C. The speed bumps are located in the respective cam tracks 18 and 20 adjacent the edges 43 and 45 of the first thread segments 26 and 28. The speed bumps 60 and 62 gradually increase in height or thickness in one direction of movement of the closure 46, i.e. closing direction, on the finish as shown in FIG. 2B and operate to impede the rotational movement during removal of the closure 46 by contacting cam followers on the closure as shown in FIG. 2C. Like interviewing stops 38 and 40, the speed bumps act to delay closure removal. In the present location, the speed bumps 60 and 62 additionally act to impede the movement of lowermost follwer 82 as it passes under intervening stops 38 and 40, thereby increasing the time that said follower is positioned under said intervening stops. This action helps to ensure that lowermost follower 82 will engage intervening stops 38 and 40. However, the number and location of the speed bumps is flexible and is governed by the needs of the designer.

Figure 2D:
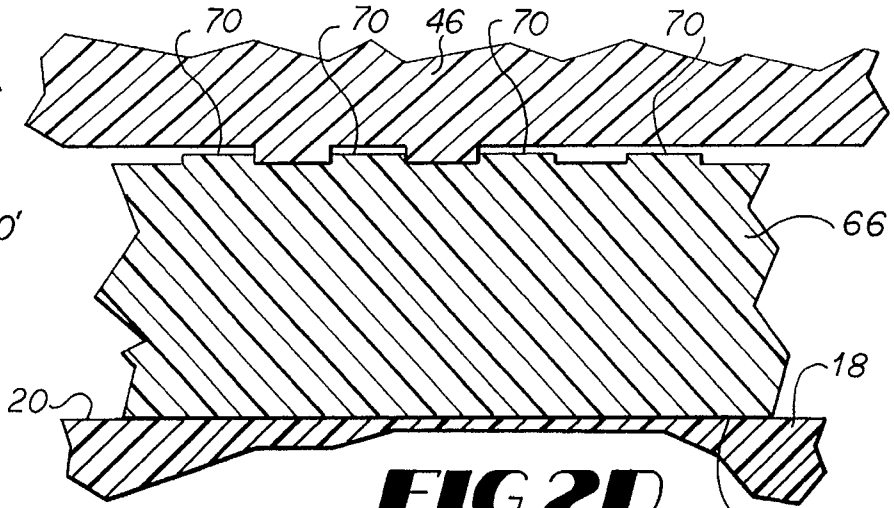
FIG. 2D is a partial cross-sectional view illustrative of a portion of a finish thread segment and an inside closure surface as shown in FIG. 2 and being further illustrative of the anti-backoff device thereon.
Figure 5:
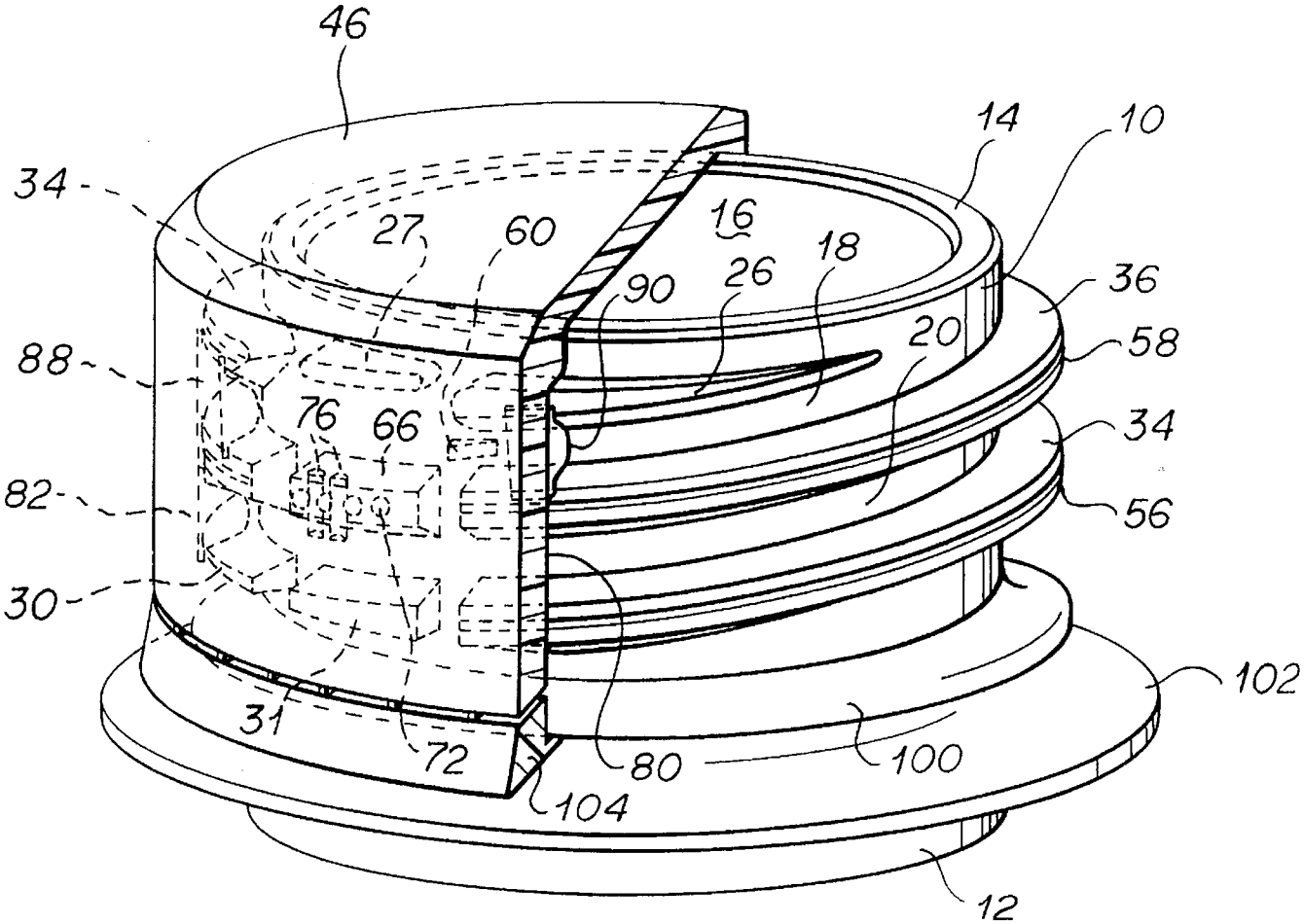
FIG. 5 is a perspective view of the finish shown in FIG. 4 with a partial sectional view of a closure thereon in a sealed closed position.

Additionally, anti-backoff devices 66 and 68 are shown in FIG. 1, one of which 66 is further depicted in FIG. 2D, are included between intermediate thread segments 34 and 36 of the raised threads 22 and 24 and shown located 180° apart from each other midway along the length of the raised threads 22 and 24. The anti-backoff devices 66 and 68 comprise thread segments which are similar in shape to the thread segments 34 and 36 in that they include inclined sidewalls 23 and 25; however, they now include four raised circular bumps 72 and 74 as shown, for example, in FIGS. 1 and 2D which are adapted to selectively engage pairs of bar members 76 and 78 formed on the inside surface 80 of the closure 46 as shown in FIGS. 2 and 5.

The pairs of parallel bar members 76 and 78 are designed to straddle at least one of the four bumps 72, 74 of the anti-backoff devices 66 and 68 as shown in FIG. 2. The parallel bar elements 76 and 78, when in place over one of the bumps of the finish, act as restraining means for preventing the closure member 46 from backing off the finish and leaking when container or bottle pressure forces the closure 46 upward against the finish. It should be noted, however, that anti-backoff devices 66 and 68 are easily overcome during normal closure removal by the consumer because said devices restrict closure movement in a static situation only, not a dynamic one. Also, anti-backoff devices 66 and 68 can be modified, as desired, for example, as shown in FIGS. 2E, 2F and 2G and which will be subsequently considered.

Referring now to FIGS. 2 and 2A, shown thereat are the details of the elements located on the inside surface 80 of the closure 46 which fit into and mate with the cam tracks 18 and 20 between the spiral threads 22 and 24. The structure of the closure elements comprises, in addition to the pairs of the anti-backoff bars 76 and 78, plural sets of raised cam followers consisting of, for example, a lead cam follower segment 82, three equally spaced intermediate cam follower segments 84, 86, and 88 and two trailing cam follower segments 90 and 92.

Each of the cam follower segments 82 . . . 92 has a cross section as shown in FIG. 2A where the cam follower segment 90, for example, includes a pair of inwardly sloping side surfaces 94 and 96, and a rounded tip or outer end portion 98. The side surfaces 94 and 96 are adapted to ride in and contact the outwardly diverging side surfaces 23 and 25 of the cam tracks 18 and 20. The cam follower segments 82 . . . 88, moreover, include pairs of shoulder surfaces 93 and 95 which ride on the top surfaces of the raised thread segments 26, 28, 30, 32, 34 and 36 of FIG. 1 and whose purpose is to provide a space between these top thread surfaces and the closure sidewall 80 to allow venting of headspace gas.

Figure 2F:
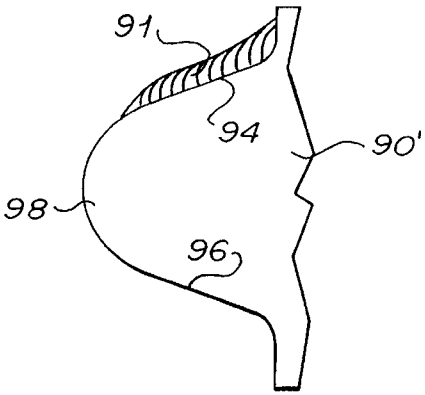
FIGS. 2E–2G are views illustrative of an alternate anti-backoff device.
Figure 2G:
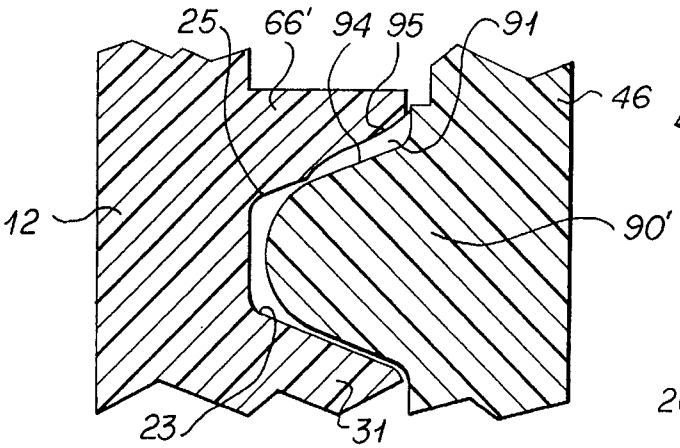
Figure 2E:
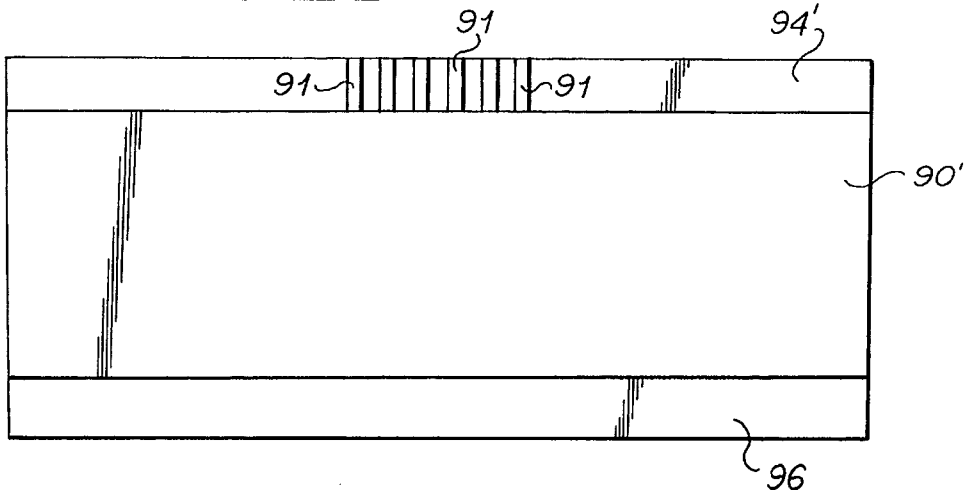

One variation of the anti-backoff devices shown in FIGS. 1 and 2, for example, and as noted above, embodies a notch (finish) and ridge (closure) structure as shown in FIGS. 2E, 2F and 2G. FIG. 2E discloses a plan view of a cam follower 90' on the closure 46 containing a set of ridges 91 arranged along one side surface 94 which will mate with one or more notches in the finish sidewall, for example, wall surfaces 23 and 25 on thread segments 26 and 28, respectively. FIG. 2F discloses a partial end view thereof. FIG. 2G is a partial cross-sectional view illustrative of the cam follower segment 90' having a ridge 91 engaging a notch 95 in the inclined walls 25 of the thread segment 28 (FIG. 1) when bottle pressure forces the closure 46 upward against the finish. Like anti-backoff devices 66 and 68, this anti-backoff devices is easily overcome during normal closure removal by the consumer.

Figure 6:
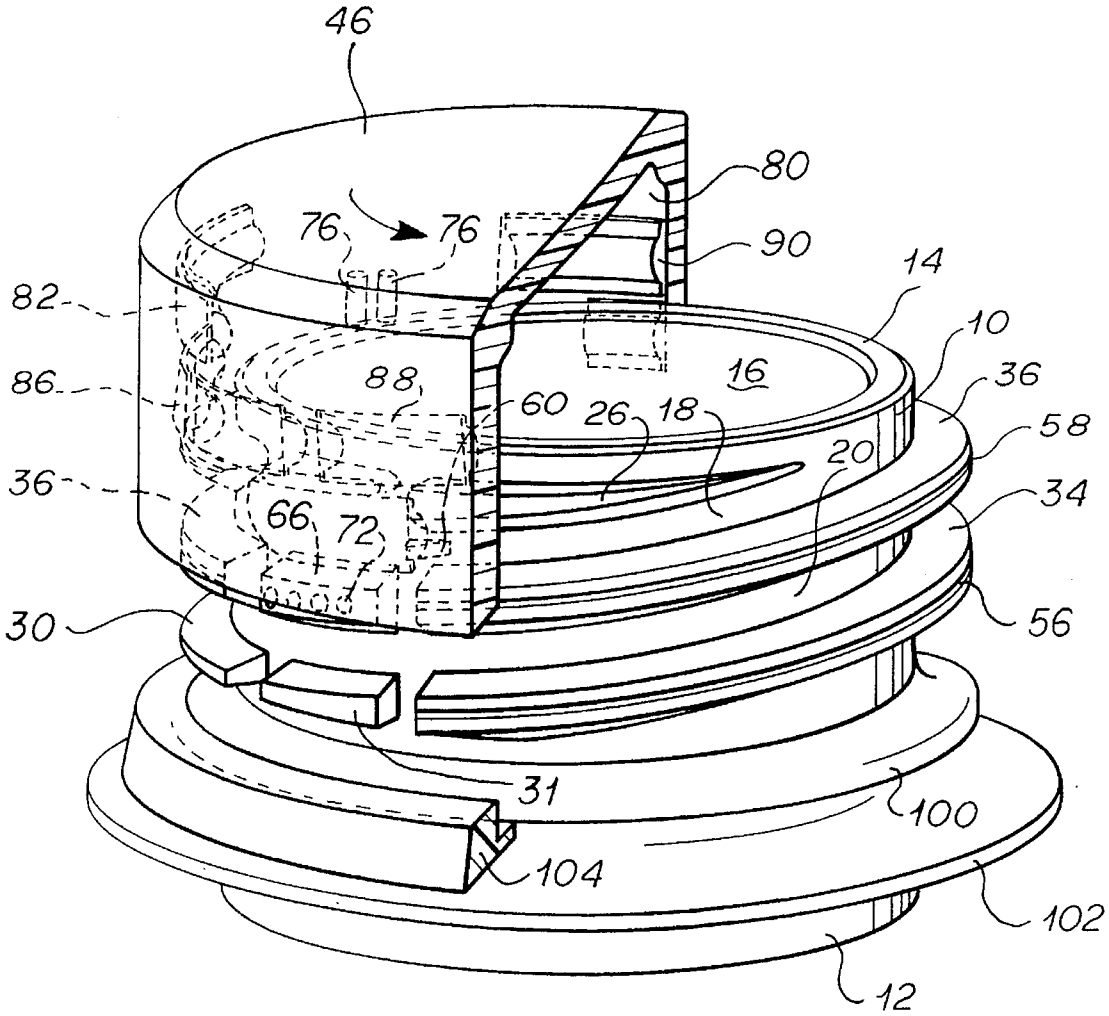
FIG. 6 is a perspective view of the finish shown in FIG. 4 with the closure shown in FIG. 5 partially disengaged therefrom, with the lowermost closure follower in each track engaged in the intervening stop in each track.

Referring now to FIGS. 4, 5 and 6, where the elements depicted in FIGS. 1, 2 and 3 are now illustrated in perspective form, FIG. 4, for example, shows the neck portion 12 including the top annular rim 14 which provides an uninterrupted sealing surface for the closure member 46 shown partially cut away in Figures 5 and 6. There is also now shown a locking ring member 100 and an annular support ledge 102. The locking ring is adapted to hold in place a tamper-evident band 104, with FIG. 5 additionally illustrating a plurality of equally spaced frangible bridge members 106 which connect to the closure member 46. The support ledge 102 provides a means to support the bottle during closure application to keep it from collapsing when downward force is exerted by a closure capping head.

An initial counterclockwise rotation of the closure 46 during opening causes it to move axially on the bottle neck 12 so as to open the container. The frangible bridge members 106 break and in doing so provide an indication as to whether or not the container has been opened prior to use.

It is important to note that with the arrangement shown in FIGS. 1–3 and 4–6, there is always closure engagement across a minimum of 180° of the finish when at least two cam tracks, e.g. cam tracks 18 and 20, are used. This facilitates closure application and removal.

Having thus shown and described what is at present considered to be the preferred embodiment of the invention, it should be noted that the same has been made by way of illustration and not limitation. Accordingly, all modifications, alterations and changes such as the size, shape, number and location of the various elements coming within the spirit and scope of the invention as set forth in the appended claims are herein meant to be included.

We claim:

1. In combination a closure, carbonated beverage container and finish system therefor, comprising:

a finish located on one member of a pair of members including a neck portion of a cylindrical container or an inside surface of a skirt portion of a closure and including at least two equally spaced cam tracks each spiraling around and making at least one complete revolution on a wall surface of said one member, said cam tracks being located between raised helical threads comprised of a plurality of thread segments on said one member, said at least two cam tracks further having respective equally spaced starting points on said wall surface;

plural sets of raised cam follower segments located on the other member of said pair of members for mating with said cam tracks of said one member, said cam follower segments having outwardly projecting body portions which fit into said cam tracks while contacting opposite adjacent surface portions of said threads, whereby relative rotation of the closure and finish produces an axial movement of the closure; and pressure-actuated delay means for responsive to headspace gas pressure in the container for permitting at least one axial jog between said cam tracks and said cam follower segments during closure removal for slowing the speed of removal of the closure from the container during said relative rotation of the closure and finish.

2. A closure, container and finish system according to claim 1 wherein said pressure-actuated delay means comprises an axial slot in the finish for permitting said at least one axial jog.

3. A closure, container and finish system according to claim 1 and additionally including intervening stop means selectively located along said cam tracks for further delaying removal of the closure during opening of the container.

4. A closure, container and finish system according to claim 3 wherein said intervening stop means comprises means for contacting and impeding movement of at least one of said cam follower segments in one direction of rotation of said closure.

5. A closure, container and finish system according to claim 4 wherein said intervening stop means comprises an inner side edge of one of said thread segments and an inner end edge of another of said thread segments adjacent said one thread segment and the space in immediate proximity to said side and end edges.

6. A closure, container and finish system according to claim 5 and additionally including closure movement impedance means located in said cam tracks adjacent said intervening stop means to further impede movement of said closure during removal thereby enhancing engagement of said at least one cam follower with said intervening stop means by increasing the time that said at least one cam follower is positioned under said intervening stop means.

7. A closure, container and finish system according to claim 6 wherein said closure movement impedance means comprise at least one speed bump, comprising a longitudinally extending raised body member varying in height along a length dimension of said cam tracks and becoming higher in a closing direction of said closure on said finish.

8. A closure, container and finish system according to claim 1 and additionally including means located in said cam tracks for contacting and additionally impeding movement of said closure during removal from said finish.

9. A closure, container and finish system according to claim 8 wherein said means for contacting and impeding movement comprises at least one ramp type speed bump.

10. A closure, container and finish system according to claim 1 and additionally including a combination of at least one venting slot running transverse to said cam tracks and said thread sections and longitudinally extending venting grooves located in a top surface of said threads so as to provide for release of headspace gas during removal of a closure from the container.

11. A closure, container and finish system according to claim 1 and additionally including anti-backoff means for preventing undesired back-off of the closure from the finish prior to closure removal.

12. A closure, container and finish system according to claim 11 wherein said anti-backoff means comprises at least one first type member on said finish aligned with said thread segments and at least one second type member located on said closure complementary with said first type member for engaging and holding said second type member.

13. A closure, container and finish system according to claim 12 wherein said at least one first type member comprises a thread type segment including a first type raised surface element located thereon and said second type member comprises a second type raised surface element on the inside wall surface of said closure.

14. A closure, container and finish system according to claim 13 wherein said first type raised surface element comprises at least one circular type bump on a top surface of said thread type segment and wherein said second type of raised surface element comprises at least one pair of generally parallel bar type members which operate to contact and straddle said circular type bump.

15. A closure, container and finish system according to claim 12 wherein said at least one first type member comprises a thread type segment including notch means and said second type member comprises a cam follower member including ridge means for engaging said notch means of said thread type segment.

16. A closure, container and finish system according to claim 15 wherein said notch means comprises at least one notch in a side surface of said thread type segment and said ridge means comprises at least one ridge on a side surface of said cam follower member.

17. A closure, container and finish system according to claim 10 wherein said thread segments have substantially flat top surfaces adjacent said venting grooves and downwardly inclined sidewall surfaces, said sidewall surfaces of adjacent thread segments diverging mutually outwardly from each other.

18. A closure, container and finish system according to claim 17 and wherein said plurality of thread segments include tapered first and last thread segments for aiding the engagement and disengagement of said cam follower segments therefrom.

19. A closure, container and finish system according to claim 17 and wherein each of said cam follower segments include a pair of substantially flat shoulder surfaces for respectively contacting the flat top surfaces of adjacent thread segments of said thread segments.

20. A closure, container and finish system according to claim 1 and additionally including an annular locking ring on said neck portion below said finish and tamper-evident closure means secured to said locking ring.

21. A closure, container and finish system according to claim 20 wherein said tamper-evident closure means includes a tamper-evident band secured to said locking ring and a plurality of selectively spaced frangible bridge members interconnecting said closure and said tamper evident band.

22. A closure, container and finish system according to claim 2 further including stop means associated with each of said slot means for temporarily engaging cam follower segments during said at least one axial jog.

* * * * *